United States Patent [19]

Wear et al.

[11] 4,347,670

[45] Sep. 7, 1982

[54] APPARATUS AND PROCESS FOR DRYING GRANULAR PRODUCTS

[75] Inventors: Frederick C. Wear, St. Louis; Dick Q. Durant, Manchester, both of Mo.; Howard F. McKinney, Edwardsville, Ill.

[73] Assignee: McDonnell Douglas Corporation, St. Louis, Mo.

[21] Appl. No.: 211,308

[22] Filed: Nov. 28, 1980

[51] Int. Cl.[3] ..... F26B 23/08

[52] U.S. Cl. ..... 34/1; 34/92; 34/167; 34/176; 219/10.55 R

[58] Field of Search ..... 34/92, 1, 147, 167, 34/169, 176, 171, 178, 174; 285/417; 219/10.55 R

[56] References Cited

U.S. PATENT DOCUMENTS

| | | | |
|---|---|---|---|
| 826,729 | 7/1906 | Marsh | 34/147 |
| 3,859,734 | 1/1975 | Wahlgren | 34/92 |
| 4,015,341 | 4/1977 | McKinney et al. | 34/92 |
| 4,091,252 | 5/1978 | Koinuma . | |
| 4,249,891 | 2/1981 | Noyes et al. | 34/171 |
| 4,283,079 | 8/1981 | Flaherty | 285/417 |

*Primary Examiner*—Larry I. Schwartz

*Attorney, Agent, or Firm*—Gravely, Lieder & Woodruff

[57] ABSTRACT

An apparatus for drying seeds and other granular products includes a drying vessel that is connected to a vacuum pump which evacuates air from its interiors. The drying vessel has an enclosing side wall and a tubular portion which is surrounded by the side wall, all such that an annular drying cavity is formed within the vessel. The tubular portion is made from a material that is transparent to microwave energy and houses waveguide-radiators, each of which is connected to a different microwave launcher that is located at the lower end of the transparent tubular portion. The launchers produce microwave energy that is directed into their respective waveguide-radiators which in turn allow the energy to escape through apertures in their side walls. This energy passes through the transparent tubular portion of the drying vessel and into the drying cavity of the vessel. Within the annular drying cavity, the vessel contains drying columns into which the granular product is directed. The columns are formed from a material that is transparent to the microwave energy and are offset angularly with respect to the waveguide-radiators, so the microwave energy emitted from the apertures for the most part reflects from the side wall of the vessel. This minimizes first pass energy impingement on the product and thereby provides a more uniform field for drying the product within the columns. The rate at which the granular product descends through the columns is controlled by vaned rotors. The moisture released from the product in the form of steam passes through a condenser where it condenses to water, and this serves to maintain the vacuum in the drying cavity.

28 Claims, 7 Drawing Figures

A
2
4
6
8
10
12
14
16
18
20
22
24
26
28
29
62
70
82
86
88
89
90
91
92
94
96
100
110
124
126
128
130
132
134
136
138
x

APPARATUS AND PROCESS FOR DRYING GRANULAR PRODUCTS

BACKGROUND OF THE INVENTION

This invention relates in general to the drying of granular products and more particularly to an apparatus and process for drying granular products with microwave energy.

Many granular products, as orginally produced, contain an excessive amount of moisture and cannot be stored or used in that condition. Consequently, the product, whatever it may be, must be dried. Seeds such as corn, rice, and soybeans are examples of such products.

Practically all of this nation's corn, soybean, and rice harvest is currently dried in hot air dryers which consume enormous amounts of fuel and produce a considerable amount of dust. Furthermore, these dryers often raise the temperature of the seed so high that the seed is incapable of germinating, and this of course renders the product useless for planting. Even when the seed is destined solely for feeding purposes, the excessively high temperatures diminish its nutritional value, harden its shells, detract from its taste, and impair its ability to withstand long periods of storage.

Some granular products can be successfully dried with microwave energy, and the dryers which employ this form of energy usually take the form of a belt that moves the granular product through a microwave field. These dryers are useful where a high power density can be applied to the product without damage to the product, but most seeds do not fall into ths category. On the contrary, high power densities raise the temperature of the seed to excessively high values, creating all of the problems heretofore mentioned.

U.S. Pat. No. 4,015,341 discloses a seed drying apparatus that employs microwave energy for drying various seeds, but the seeds are maintained under a vacuum while being subjected to the energy. In this manner the moisture is removed at much lower temperatures. However, the critical value at which a microwave field breaks down diminishes with pressure, so that arcing and corona discharge are more likely to occur under vacuum conditions. Hence field strengths must be maintained relatively lower than would otherwise be acceptable at atmospheric pressure. Also, the apparatus of U.S. Pat. No. 4,015,341 is quite massive in relation to its productivity.

SUMMARY OF THE INVENTION

One of the principle objects of the present invention is to provide an apparatus that is capable of drying granular products with microwave energy under vacuum conditions. Another object is to provide an apparatus of the type stated that creates the microwave energy under atmospheric conditions, where arcing and corona discharge are less likely to occur, and then radiates it into a vacuum chamber where the drying takes place. A further object is to provide an apparatus of the type stated that can accommodate a large amount of granular product in comparison to its size and the amount of microwave energy that it produces. Another object is to provide an apparatus of the type stated that accommodates the product in multiple drying columns in the same vacuum chamber as the product is being dried. An additional object is to provide an apparatus of the type stated that can operate on a continuous basis. Still another object is to provide an apparatus of the type stated that is ideally suited for drying seeds in that it raises the seed only to moderate temperatures and thereby does not destroy its capability of germinating, nor does it harden the shell or detract from the taste and nutritive value of the seed. Yet another object is to provide an apparatus of the type stated which subjects the granular product to a uniform microwave field while the product is maintained within a vacuum. These and other objects and advantages will become apparent hereinafter.

The present invention is embodied in an apparatus comprising a drying vessel having a portion formed from a material that is transparent to microwave energy, confining means within the vessel for defining a channel through which a granular product passes, and means for producing microwave energy that is directed through the transparent portion of the vessel and into the interior of the vessel where it passes through the granular product in the drying column and evaporates moisture from that product. The invention also resides in the process of directing microwaves from a region of atmospheric pressure to a region of reduced pressure, the latter region containing a granular product which is dried by the microwaves. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur—

FIG. 3 is a sectional view taken along line 3—3 of FIG. 2 and showing the distributor chute within the drying vessel;

FIG. 4 is a sectional view taken along line 4—4 of FIG. 2 and showing the drying columns, the tubular window, and the waveguide-radiators within the drying vessel;

DETAILED DESCRIPTION

Figure 1:
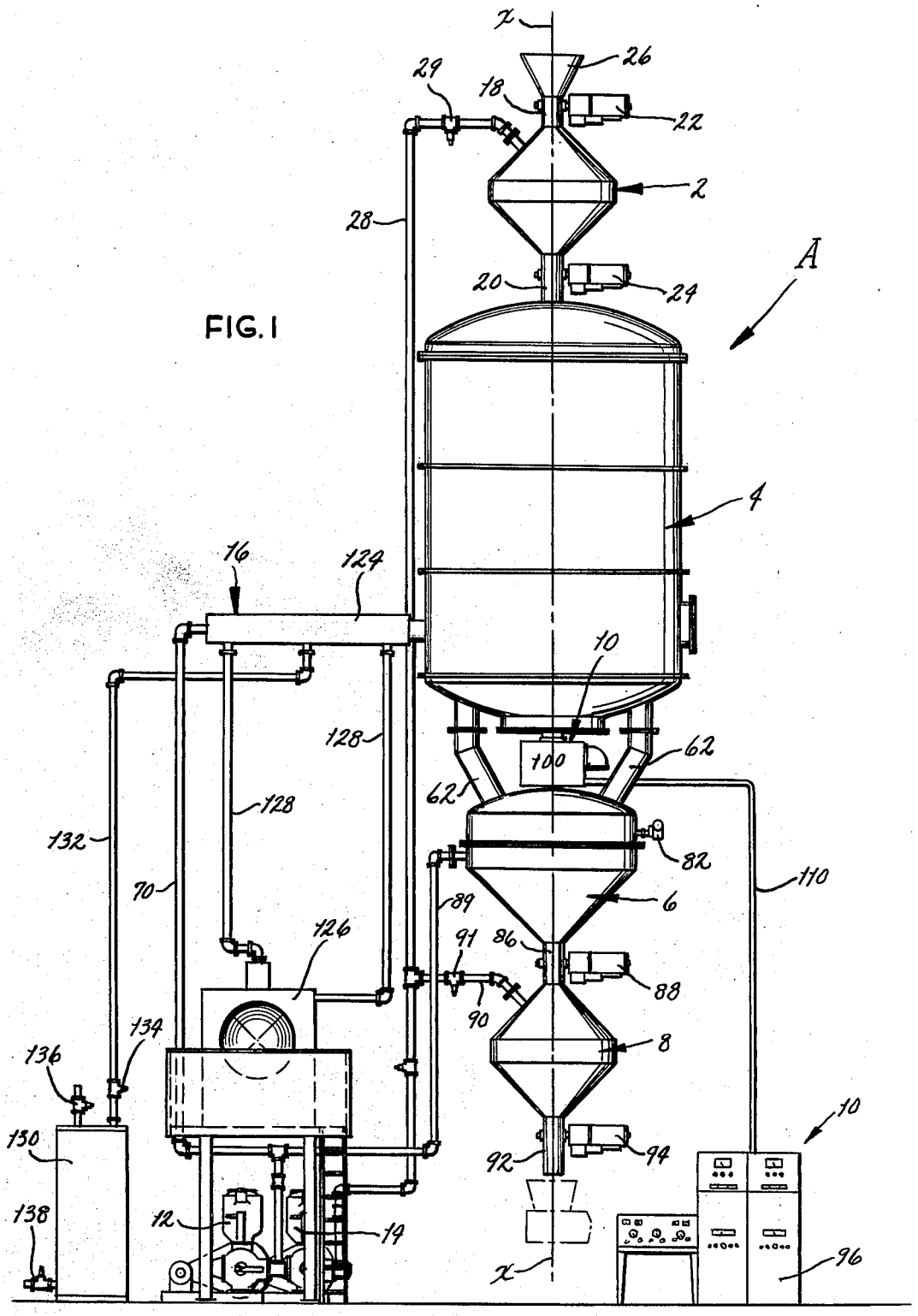
FIG. 1 is an elevational view of the drying apparatus constructed in accordance with and embodying the present invention.

Referring now to the drawings, a drying apparatus A (FIG. 1) is suited for drying nodular or granular products which cannot or should not be subject to excessively high temperatures. As such it is ideal for drying seeds, such as corn, rice, soybeans, cereal grains, and the like, none of which can be stored for sustained periods of time with a high moisture content. The dryer A basically includes an upper lock hopper 2 into which the granular product is placed, a drying vessel 4 to which the granular product is fed from the lock hopper 2, a collecting tank 6 in which the dried product is collected after leaving the drying vessel, and a lower lock hopper 8 into which the dried product is directed from the collecting tank 6, all arranged in that order in the direction of product flow through the drying apparatus A. In addition, the drying apparatus A includes a microwave generator 10 for producing microwave energy that is directed into the drying vessel 4 to dry that granular product within it. It also includes a vacuum pump 12 for evacuating the drying vessel 4 and collecting tank 6 and another vacuum pump 14 for evacuating the two lock hoppers 2 and 8. Completing the drying apparatus A is a condensing unit 16 which condenses the water vapor that is extracted from the granular product within the drying vessel 4.

The upper lock hopper 2 (FIG. 1) is essentially an air-tight vessel having short transfer tubes 18 and 20 extended from each of its ends, and each of these tubes 18 and 20 is large enough to serve as a conduit for the granular product. The upper tube 18 contains a valve 22, while the lower tube 20 contains a valve 24. Both of the valves 22 and 24 are capable of completely sealing their respective tubes 18 and 20, that is the ends of the hopper 2, to the extent that the hopper 2 is rendered air-tight, yet the valves 22 and 24 can be opened sufficiently to allow the granular product to pass into the hopper 2 or from it, whatever the case may be. The upper tube 18 has a flared inlet chute 26 connected to it for receiving the granular product that is to be dried. Finally, the hopper 2, in the region immediately below the upper transfer tube 18 is connected to a vacuum line 28 that leads to the suction port of the vacuum pump 14. The line 28 contains a valve 29.

Figure 2:
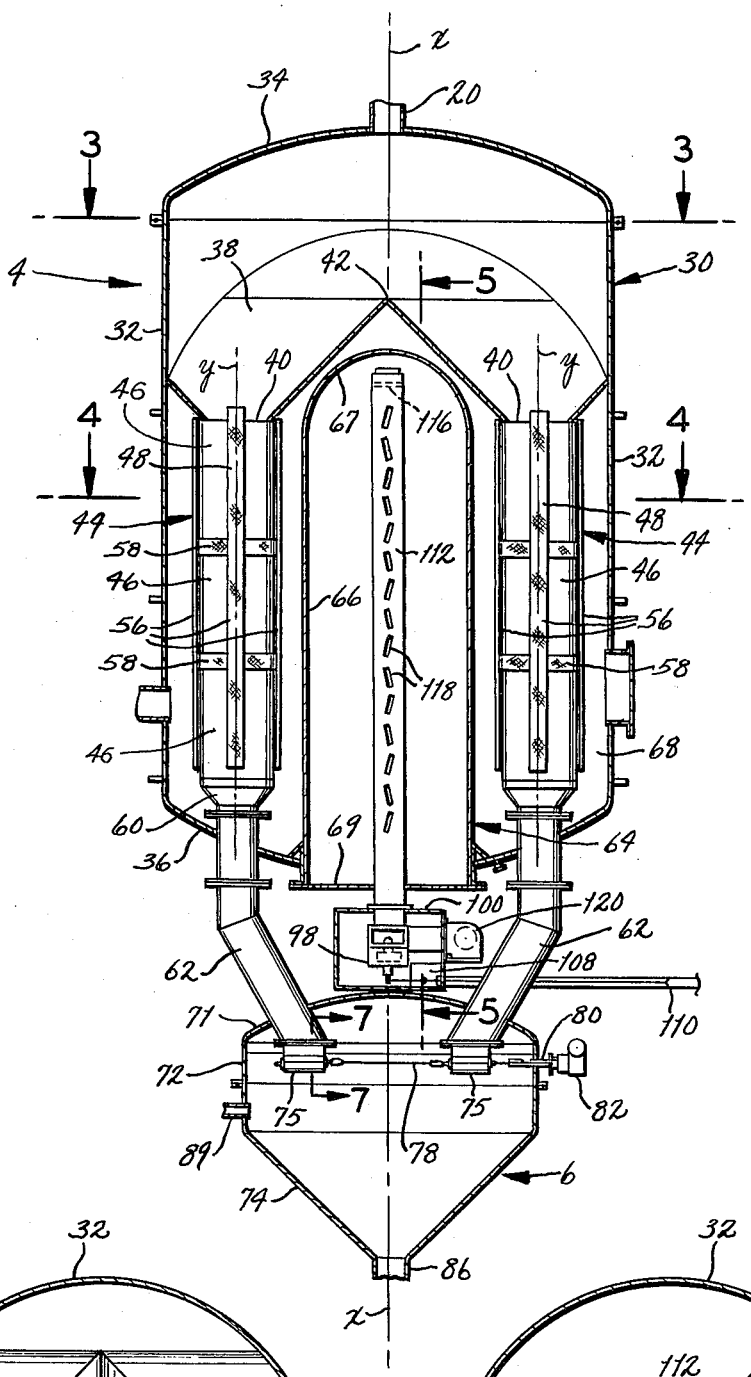
FIG. 2 is an enlarged sectional view of the drying vessel and collecting tank forming part of the drying apparatus.

The drying vessel 4 (FIG. 2), which is symmetrical about its center axis X, includes a steel shell 30 having a cylindrical side wall 32, a domed upper wall 34, and an annular bottom wall 36, the last of which extends downwardly and inwardly. The side wall 32 and bottom wall 36 are welded together at an air-tight joint. The domed upper wall 34 is, on the other hand, fitted to the side wall 32 at an air-tight seal, such that the upper wall 34 may be removed to service components within the shell. The lower transfer tube 20 of the upper lock hopper 2 opens into the interior of the shell 30 at the center of its domed upper wall 34, so that when the lower valve 24 is opened, the granular product drops into the upper end of the shell 30.

Within the shell 30 is a distributor chute 38 (FIGS. 2 and 3) which is located directly below the domed upper wall 34. The chute 38, which is fabricated from metal so as to reflect microwave energy, is contoured to direct the granular product which falls onto it from the lower transfer tube 20 to two circular openings 40 which are located 180° from each other and equidistantly from the axis X of the vessel 4. To this end the chute 38 has a peaked center section 42 which is located between the two openings 40 and insures that the granular product, upon encountering it, is diverted evenly to the two circular openings 40. Of course, the circular openings 40 form the lowermost portions of the distributor chute 38.

Directly beneath each circular opening 40 in the distributor chute 38 is a drying column 44 (FIG. 2) having an axis Y that is parallel to the axis X of the shell 30. Each column 44 consists of a series of tubular sections 46 which are aligned end-to-end along the axis Y and a harness 48 that maintains the alignment of the tubular sections 46 and suspends them from the chute 38. Indeed, the harness 48 supports adjacent sections 46 such that their ends are spaced slightly apart. Both the tubular sections 46 and the harness 48 are formed from a dielectric material which is transparent to microwave radiation of the frequency produced by the microwave generator 10. Polypropylene is suitable for the sections, while a porous monmetallic fabic is suitable for the harness 48. Since the column 44 is disposed within a microwave field during the operation of the drying apparatus A, none of the components for the column 44 should contain any metal.

Figure 6:
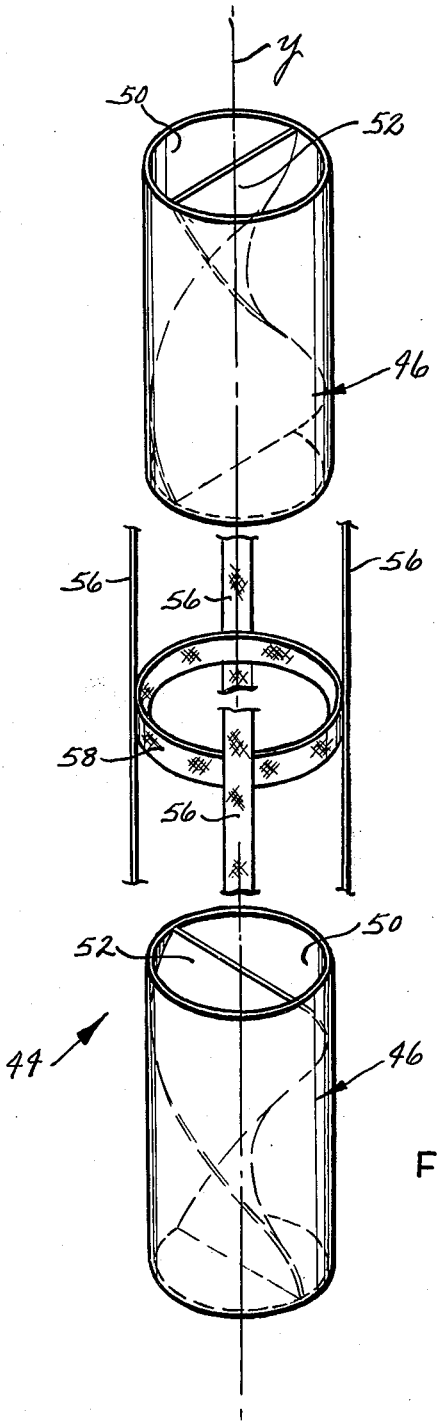
FIG. 6 is an exploded perspective view of one of the drying columns.

Each section 46 (FIG. 6) has a cylindrical side wall 50, the radius of which is no greater than the effective penetration depth of the microwave energy into the granular product. Normally, this is not greater than about 12 inches, for most products, but the determining factor is the dielectric properties of the product being dried. In other words, the microwave energy must be capable of reaching the granular product at the center of the section 46 and dissipating moisture from the product in that region, and accordingly the radius of the section 46 cannot be so great as to thwart that end. The side wall 50 may contain apertures to facilitate the escape of water vapor from the column 44. Within the cylindrical side wall 50 of each section 46 is a turning vane 52 that spirals downwardly from the upper end of the section 46 to its lower end, turning one-half revolution (180°) as it does. The vane 52 is as wide as the interior of the tubular section 46 and is attached to the inside surface of the side wall 50 along both of its side margins. Moreover, the vanes 52 for succeeding sections 46 spiral in opposite directions, and at their adjacent ends are offset angularly 90° with respect to each other. Thus, if the vane 52 for one section 46 has a right hand spiral, the vanes 52 for the sections 46 at each end of that section 46 have a left hand spiral. Also, the end of the vane 52 for one section 46 will be at right angles to the beginning of the vane 52 for the next section 46. This particular arrangement of the vanes 52 causes the product to move inwardly and outwardly in the column 44 as it descends so that all granules are exposed to substantially the same amount of microwave energy while they are in the column 44.

The harness 48 (FIGS. 2 and 4) for each column 44 includes several straps 56 which are attached to the distributor chute 38 and extend along the outside of the column 44 where they are attached to the cylindrical walls 50 of the tubular sections 46 by screws, pins, or other devices which are easily detached. In this way the tubular sections 46 are supported with the ends of adjacent sections 46 spaced slightly apart. In addition, the harness 48 includes bands 58 which are attached to the straps 56 and extend around the tubular sections 46 at the ends of those sections. Indeed, each band 58 bridges the space between the two adjacent sections 46 to maintain the alignment between those sections and to prevent the product from escaping through the space. In this regard, the bands 58 are made from a fabric having a mesh which is small enough to prevent the product from passing through it, yet water vapor that is evaporated from the product can easily pass through the fabric. The fabric of the bands 58 should also be transparent to the microwave energy.

The uppermost tubular section 46 of each column 44 aligns with one of the circular openings 40 in the distributor chute 38 (FIG. 2), and indeed the chute 38 at the openings 40 has a downwardly directed lip which projects into the uppermost section 46 and maintains the alignment. The lowermost section of each column 44 rests on a transition 60 which is located within the shell 30 immediately above its bottom wall 36. Like the chute 38, the transition 60 has a lip, and that lip projects into the lowermost tubular section 46 to maintain the alignment. Each transition 60 in turn is connected to a transfer pipe 62 that passes through the bottom wall 36 of the shell 30 and into the collecting tank 6 so that the granular product, after being subjected to microwave energy within the drying vessel 4 is discharged into the collecting tank 6.

Aside from the two drying columns 44, the interior of the shell 30 is also occupied by a tubular window 64 (FIGS. 2, 4, and 5) which is actually part of the drying vessel 4. The window 64 is transparent to the microwave energy produced by the microwave generator 10, yet is strong enough to withstand the atmospheric forces imposed upon it by reason of the vacuum that is maintained within the drying vessel 4. Fiber glass is a suitable substance from which the window 64 may be molded or otherwise formed. The window 64 has a cylindrical side wall 66 that extends vertically concentric to the axis X of the shell 30 and a domed upper wall 67 into which the side wall 66 merges at its upper end. The side wall 66 of the window 64 together with the side wall 32 of the shell 30 define an annular drying cavity 68 in which the two drying columns 44 are located. The domed upper wall 67 of the window 64 lies within the space formed by the peaked center section 42 of the distributor chute 38. The bottom of the tubular window 64, on the other hand, is closed by a plate 69 having vent apertures near its periphery so that the interior of the window 64 is at atmospheric pressure. At its lower end, the window 64 is provided with a flange which is bolted securely to the bottom wall 36 of the shell 30 such as to create an air-tight seal between the shell 30 and window 64. In this manner, the window 64 is supported on the shell 30, to isolate the annular drying cavity 68 from the surrounding atmosphere. The vacuum pump 12 is connected with the cavity 68 through a vacuum line 70 (FIG. 1) to evacuate air and water vapor from the cavity 68.

Figure 7:
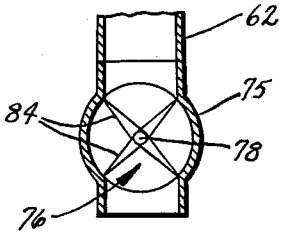
FIG. 7 is a sectional view taken along line 7—7 of FIG. 5 and showing one of the vaned rotors for controlling the rate at which product is discharged from a drying column.

The collecting tank 6 (FIG. 2) has a domed upper wall 71, a short cylindrical side wall 72, a conical lower wall 74, all of which are joined together along air-tight joints. Each of the two transfer pipes 62 that leads from the drying vessel 4 extends through the domed upper wall 71 and terminates at a small cylindrical housing 75 (FIG. 7) that is located within the interior of the collecting tank 6 with its axis extending horizontally. Moreover, each housing 75 is open at its bottom so that the granular product will pass by gravity from the drying vessel 4 into the collecting tank 6. The rate at which the granular product discharges into the collecting tank 6 is determined by control rotors 76 which are located within the cylindrical housing 75 at the lower ends of the pipes 62, the rotors 76 being on a common shaft 78 that projects through an air-tight seal 80 in the side wall 72 of the tank 6. The shaft 78 and the rotors 76 upon it are turned by a variable speed gear motor 82. Each rotor 76 possesses a plurality of radially directed vanes 84 which in effect obstruct the passage of the granular product from the lower ends of the transfer pipes 62. However, when the rotors 76 revolve, the vanes 84 pass by the ends of their respective pipes 62 and thereby permit the granular product to fall from transfer pipes 62 at a controlled rate. This enables the drying columns 44 to remain completely filled with the granular product, so that the density of microwave radiation in the product does not become excessive, and further permits the granular product to descend through the columns 44 at a velocity slow enough to enable the desired amount of moisture to be extracted.

The granular product, upon being released from the transfer pipes 62 accumulates along the bottom wall 74 of the collecting tank 6, and that wall tapers down to and merges with a transfer tube 86 (FIG. 1) by which the collecting tank 6 is connected with the lower lock hopper 8. The tube 86, in turn, contains a valve 88 that when opened permits the granular product to pass from the tank 6 to the hopper 8 and when closed forms an air-tight blockage in the tube 86. The interior of the collecting tank 6 is connected to a vacuum line 89 that merges with the vacuum line 70 of the drying vessel 4 so that both are evacuated by the vacuum pump 12.

The lower lock hopper 8 (FIG. 1) is essentially the same as the upper lock hopper 2 and has a vacuum line 90 connected to it. The line 90 contains a valve 91 and is connected with the line 28 from the upper lock hopper 2. Since the line 28 leads to the suction port of the vacuum pump 14, the vacuum pump 14 likewise evacuates the lower lock hopper 8. At its bottom the lower lock hopper 8 is provided with a discharge tube 92 through which the dried granular product leaves the lower lock hopper 8. The tube 92 contains a valve 94 which when open will permit the dried granular product to pass and when closed forms an air-tight blockage in the tube 92.

The valves 22 and 24 for the upper lock hopper 2 and the valves 88 and 94 for the lower lock hopper 8 are operated by an automatic sequencing system which maintains a coordinated flow of granular product through the drying apparatus A. The arrangement is such that the valves 22 and 24 are never open at the same time, and the same holds true with regard to the valves 88 and 94. The sequencing system also operates the valves 29 and 91 in the vacuum line 28 and 90, respectively, closing the valve 29 when the upper lock hopper 2 is at atmospheric pressure and the valve 91 when the lower lock hopper 8 is at atmospheric pressure.

The microwave generator 10 includes a power and control unit 96 (FIG. 1) which is located remote from the drying vessel 4 of the apparatus A, but usually near the base of the apparatus A. In addition, the generator 10 includes a pair of microwave launchers 98 (FIG. 5) that are contained within a housing 100 which is immediately below the tubular window 64 for the drying vessel 4. Each launcher 98 has a magnetron tube 102, an electromagnet 104 that surrounds the magnetron tube 102, and in addition a horizontal waveguide section 106. The microwaves are produced at the magnetron tube 102 which projects into the waveguide section 106 as an antenna, so that the section 106 provides direction to the waves. Each launcher 98 is further associated with a filament transformer 108 which supplies the filament of the magnetron tube 102 with electrical current of very high magnitude. Consequently, it is desirable to have the transformer 108 close to the launcher 98, and the housing 100 is a suitable location. The launchers 98 and the power and control unit 96 are connected together through an electrical cable 110 which carries electrical energy for energizing the electromagnets 104, the filament transformers 108, and carrying the high-voltage direct-current necessary for causing the magnetrons 102 to emit microwave radiation.

Figure 5:
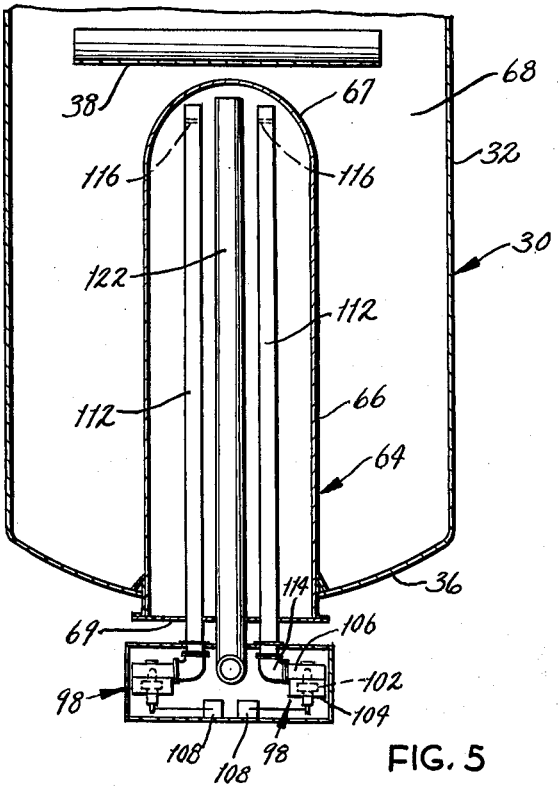
FIG. 5 is a sectional view taken along line 5—5 of FIG. 2 and showing the launcher units and their respective waveguide-radiators.

Aside from the control unit 96 and launchers 98, the microwaave generator 10 also includes a pair of waveguide-radiators 112 (FIGS. 2, 4, and 5) which extend upwardly into the interior of the tubular window 64 of the drying vessel 4 on each side of the axis X, there being a separate waveguide-radiator 112 for each launcher 98. Each waveguide-radiator 112 is parallel to the axis X and is essentially a metal tube of rectangular cross-section that extends through the plate 69 at the lower end of the tubular window 64 and then into the housing 100 where it is connected with the horizontal waveguide section 106 of its launcher 98 through a curved transition 114 (FIG. 5).

The microwaves that are produced at the launcher units 98 should be at a frequency that is capable of exciting water molecules to the extent that they will vaporize liquid water within the reduced atmosphere of the drying cavity 68. Suitable frequencies lie between $10^2$ MHz and $10^4$ MHz, but as a practical matter only 91 MHz and 2450 MHz should be used, because only those frequencies are allocated for commercial microwave heating. In this regard, it should be recognized that lower frequencies increase the likelihood of undesirable arcing and glow dischaarge, whereas higher frequencies decrease the ability of the microwaves to penetrate the product.

Each waveguide-radiator 112 constitutes nothing more than a metal tube of rectangulaar cross-section, with the tube having a short circuiting device 116 (FIG. 2) at its upper end and a plurality of slots 118 (FIG. 2) located along one of its side walls, namely the side wall that is presented closest to the side wall 66 of the tubular window 64. Being a metal tube, the waveguide-radiator 100 directs or channels the microwave energy that is produced at its launcher 98 upwardly through its hollow interior. All of this energy escapes through the slots 118 with the intensity of radiation emitted from the individual slots 118 being about equal. It is at the slots 118 where the microwave field has its greatest strength, but the slots 118 are at atmospheric pressure, where the tendency for arcing and glow discharge is minimal, at least in comparison to the low pressure of the drying cavity 68. While the slots 118 lie along and follow the longitudinal axis of the wall in which they are located, they are not parallel to that axis, but instead are slightly oblique with adjacent slots 118 being inclined in opposite directions, but at generally the same angle. The length-to-width ratio of each slot 118 is about 10:1, and the perimeter of each slot 118 is slightly less than the length of one free-space wavelength, for the microwaves produced by the launcher 98. Thus, the slots 118 are resonant insofar as the microwaves at the operating frequency are concerned, that is they act as resistive elements without inductive or capacitive reactance. Also, the slots 118 measured from midpoint to midpoint are spaced from one another by a distance equal to one-half the wavelength of the microwaves in the waveguide-radiators 112. Moreover, the normalized resistance for each slot 118 is equal to the inverse of the number of slots 118 in the waveguide-radiator 112. Also, the normalized resistance of a slot 118 is dependent on the angle of the slot 118 with respect to the centerline or axis along which the slots 118 are located. The theory concerning the positioning of the slots is discussed in Silver, Samuel, *Microwave Antenna Theory & Design,* McGraw Book Co., Inc., 1949, pages 291–301.

In the alternative the slots may be in a shunt displaced array in which they are arranged in two rows, with one row being on one side of the centerline for the wall in which the slots are located and the other row being on the other side of the centerline. The slots of each row align end-to-end and are parallel to the axial centerline. Moreover, while the spacing between the slots of each row is equal, the slots of the one row are staggered with respect to the slots of the other row. In the shunt displaced array the normalized resistance for each slot is equal to the number of slots. It is also dependent on the displacement off or from the centerline for the array.

The short circuiting device 116 at the upper end of each waveguide-radiator 110 is adjustable upwardly and downwardly to enable it to assume a position in which the energy reflected back to the launcher 98 is minimized.

The two waveguide-radiators 112 are offset 90° with respect to the two drying columns 44 (FIG. 4), so that the microwave energy emitted from the slots 118 is not directed at the drying columns 44. Instead the energy is directed through the tubular window 64 and at the interior surface of the side wall 32 for the shell 30 of the drying vessel 4. The microwave energy reflects from these walls and in so doing eventually passes through the drying columns 44 where it excites the water molecules in the granular product contained with the drying columns 44. Thus, the product does not receive direct microwave radiation from the waveguide-radiators 112, but instead receives reflected or indirect radiation.

Mounted on the housing 100 generally between the two launchers 98 within it, is an exhaust fan 120 (FIG. 2), the suction port of which is connected to an exhaust tube 122 that extends upwardly through the tubular window 64 concentric to the axis X and terminates close to the domed upper wall 68 of the window 64. The fan 120, when energized, draws air out of the window 64 and in so doing causes cool air to enter through the apertures in the plate 69 of the window 64. Thus, the air flow produced by the fan 120 cools both the waveguide-radiators 112 and the tubular window 64. With regard to the window 64, its thickness, the dielectric loss factor of the material of which it is composed, and the effectiveness of the airstream produced by the fan 120 must all be such that the side wall 66 of the window 64 is not heated to excessively high temperatures by the microwave energy.

The vacuum pumps 12 and 14 (FIG. 1) are conventional. The pump 12 should be capable of lowering the pressure within the annular drying cavity 68 of the pressure vessel 4, and also the pressure within the collecting tank 6, to about 5 mm. Hg It should further have the capability when used in conjunction with the condensing unit 16 of maintaining the interiors of the drying vessel 4 and collecting tank 6 at an operating pressure of 40 to 200 mm. Hg throughout the operation of the drying apparatus A. Similarly, the vacuum pump 14 should be capable of lowering the pressure within the lock hoppers 2 and 8 to about 5 mm. Hg, of course, when the valves 22 and 94 are closed.

The condensing unit 16 (FIG. 1) includes a counterflow heat exchanger 124 (FIG. 1) having basically a coil and a surrounding air-tight shell. The interior of the shell is at the pressure of the drying cavity 68 in the drying vessel 4, inasmuch as the shell and the drying vessel 4 are connected. Indeed, the vacuum pump 12 evacuates the drying cavity 69 through the shell of the heat exchanger 124 since the vacuum line 70 is connected to the shell of the heat exchanger 124. The coil of the heat exchanger 124, on the other hand, is connected with a cooling tower 126 through piping 128 and a pump, the latter of which circulates a liquid cooling medium such as water through the tower 126, as well as through the piping 128 and the coil of the heat exchanger 124. The cooling tower 126 of course reduces the temperature of the water passing through it, and this water passes into the coil of the heat exchanger 124. As the air and water vapor from the interior of the drying vessel 4 pass through the heat exchanger 107, the water vapor, which is derived for the most part from the granular product, condenses on the surface of the cooled coil and collects within the shell of the heat exchanger 124. Thus, the vacuum pump 12 pumps primarily air.

The shell of the heat exchanger 124 is further connected with a condensate tank 130 (FIG. 1) in which the water from the heat exchanger 124 collects, the tank 130 being located lower than the heat exchanger 124 and being connected to it through a drain line 132 that contains a valve 134. The tank 130 is sealed so as to maintain the vacuum within the drying vessel 6, yet is provided with a vent valve 136 at its top and a drain valve 138 at its bottom. The valves 134, 136, 138 when operated in the proper sequence enable the tank 130 to be drained without losing the vacuum in the drying vessel 16.

OPERATION

The granular product from which moisture is to be removed is introduced into the inlet chute 26 while the upper valve 22 of the lock hopper 2 is open and the lower valve 24 is closed. As a consequence, the granular product drops into the upper lock hopper 2 in which it collects inasmuch as the lower valve 24 is closed. Thereupon, the upper valve 22 is closed to isolate the interior of the upper lock hopper 2 from surrounding atmosphere. Thus, the vacuum pump 14 evacuates air from the interior of the upper lock hopper 2, and likewise from the interior of the lower lock hopper 8, for the valves at each end of that hopper are also closed. Since the valve 24 located ahead of the drying vessel 4 and the valve 88 beyond the collecting tank 6 are closed, the other vacuum pump 12 evacuates the interiors of the drying vessel 4 and the collecting tank 6.

Once the upper lock hopper 2 is fully evacuated, or at least reduced to a pressure slightly below the operating pressure for the drying cavity 68 of the drying vessel 4, the valve 24 in the transfer tube 20 which is located below it, is opened, and this allows the granular product to drop downwardly into the drying vessel 4. Indeed, the granular product falls upon the distributor chute 38 where it is diverted to each of the circular openings 40 which form the lowest portions of the chute 38 as well as the entrances to the two drying columns 44. The granular product thereupon gravitates into the columns 44 and passes through them at the speed determined by the rotation of the control rotors 76 at the lower ends of the transfer pipes 62 that are within the collecting tank 6. In this regard, it must be recognized that the columns 44 operate on a continuous flow so that they are always filled with the granular product. Hence, the product will not drop rapidly through the columns 44 but instead will flow at the controlled rate which is determined by the speed at which the rotors 76 revolve. As the granular product descends through the drying columns 44 it encounters the turning vanes 52 in the tubular sections 46, and these vanes tend to turn the granular product that is along them inwardly, allowing that product to be replaced by more granular product that was originally near the center of the column 44. Thus, as the granular product descends through the drying columns 44 it moves from the centers of the two columns 44 to the walls 50 of the sections 46 and then back inwardly again.

The power and control unit 96 of the microwave generator 10 supplies electrical energy to the microwave launchers 98 which are located directly below the drying vessel 4, and the launchers 98 produce microwave energy which is confined by the waveguide-radiators 112 such that the energy is directed generally upwardly through those waveguide-radiators. However, the energy escapes through the oblique slots 118 with the energy discharged from each slot 118 being of about the same intensity. The energy radiating from the slots 118 passes through the side wall 66 of the transparent window 64 and to the interior surface of the side wall 32 for the shell 30 of the drying vessel 4. It reflects from the side wall 32 and to a lesser measure from the bottom wall 36 and distributor chute 38, and after being reflected passes through the tubular sections 46 and the bands 58 of the two drying columns 44. Since the tubular sections 46 are constructed from a substance that is transparent to the microwave energy, the microwave energy enters the granular product within the columns 44 and excites the water molecules that represent the moisture content of the granular product. In short, the energy causes the molecules to oscillate and elevate the temperature of the moisture to the extent that it evaporates into the low pressure atmosphere of the drying vessel 4. This moisture passes out of the columns 44 through the porous bands 58 which hold the sections 46 in alignment. By controlling the rate of flow through the columns 44, it is possible to maintain the columns 44 in a completely filled condition, and this maintains the microwave power density within limits that the product can tolerate. In other words, a partially filled column 44 could cause the microwave energy to concentrate in the limited amount of product, all to the detriment of the product.

The vapor after migrating through the drying cavity 68, enters the shell of the heat exchanger 124, whereupon it condenses on the cool surfaces of the heat exchanger 124. This, in turn, lowers the vapor pressure within the drying cavity 68 and serves to maintain the vacuum in the cavity 68. The condensate overflows into the drain line 132 which directs it to the condensate tank 130 where it collects. Without impairing the vacuum in the drying cavity 68, the condensate tank 130 is drained from time to time by opening and closing the valves 134,136 and 138 in the proper sequence.

The dried granular product, on the other hand, descends into the transfer pipes 62 from which it is eventually discharged after passing by the vanes 84 of the two control rotors 76. The dried granular product accumulates within the collecting tank 6, and when enough granular product has accumulated to fill the lower lock hopper 8, the valve 88 at the upper end of the lower lock hopper 8 is opened, allowing the granular product to drop into the lower lock hopper 8. Of course, the pressure within the lower lock hopper 8 should be slightly below the pressure in the collecting tank 6 before the valve 88 is opened. Thereafter the upper valve 88 is closed while the lower valve 94 is opened and the dried granular product is permitted to drop out of the drying apparatus A through the discharge tube 92.

Since the microwave launchers 98 of the microwave generator 10 are located below the drying vessel 4 and remote from the power and control unit 96, the arrangement is highly compact. Moreover, the microwave energy is discharged at the location where it will dry with the greatest efficiency, that is at the center of the drying vessel. The changes of the microwave energy scorching the granular product are reduced to a minimum inasmuch as the granular product is dried primarily with indirect radiation instead of first pass radiation supplied directly from the waveguide-radiator 112. In other words, the microwaves are reflected from the interior surface of the side wall 32 for the shell 30 of the pressure vessel 4 and as a consequence are dispersed somewhat. They are also reflected by the distributor chute 38 and the bottom wall 36. The microwaves therefore do not concentrate at any one location within either of the columns 44, and this in turn permits a more uniform distribution of the energy. Moreover, the distribution of the microwave energy is substantially uniform for the full length of the drying cavity 68 owing to the arrangement of the slots 118 in the waveguide-radiator 112.

The intensity of the microwave field is greatest at the slots 118 in the waveguide-radiators 112, but the slots 118 are in a region of high pressure, that is atmospheric pressure, where the tendency for arcing and glow discharge is substantially less, at least in comparison to the vacuum conditions of the drying cavity 68. Beyond the slots 118 the field attenuates. Indeed the side wall 66 of the transparent window 64 is located in a region where the strength of the microwave field is below the critical valve at which arcing and glow discharge will occur under the reduced pressure of the drying cavity 68. Thus, no arcing or glow discharge, which might damage the product, occurs within the cavity 68.

The presence of multiple drying columns 44 minimizes the physical size of the drying apparatus A, and enables a more uniform distribution of the microwave energy to the product.

The tubular sections 46 and connecting bands 48, in effect, segment the drying columns 44, enabling them to be removed and maintained with only minimal ceiling clearance above the drying apparatus A.

While the drying apparatus A has two drying columns 44 and two waveguide-radiators 112, additional drying columns 44 and waveguide-radiators 112 may be used. In that case, it is desirable to have the waveguide-radiators 112 correspond in number to the drying columns 44, and they should further be offset angularly with respect to the drying columns 44 so that the energy discharged from their slots 104 is directed toward the shell side wall 32 instead of directly at one of the drying columns 44.

Also, the collecting tank 6 may be incorporated into the lower end of the drying vessel 4 to form a composite vessel, since the interiors of both the vessel 4 and the tank 6 are at the same pressure. In that case the launchers 98 would be located below the composite vessel and the waveguide-radiators 112 would be extended to bring them into the drying region of the vessel.

This invention is intended to cover all changes and modifications of the example of the invention herein chosen for purposes of the disclosure which do not constitute departures from the spirit and scope of the invention.

What is claimed is:

1. An apparatus for drying a granular product, said apparatus comprising: an air-tight drying vessel, a portion of which is formed from a material that is transparent to microwave energy; confining means within the vessel for defining a channel through which the product passes, said means being transparent to microwave energy; a microwave launcher for producing microwave energy; a tubular waveguide-radiator connected with the launcher and being extended along the transparent portion of the vessel such that it is exposed to atmospheric air for its entire length, the waveguide-radiator containing a plurality of apertures through which the microwave energy radiates from the waveguide-radiator, with the apertures being positioned and oriented to direct the microwave energy through the transparent portion of the drying vessel and into the interior of the vessel such that the energy will pass through the confining means and evaporate the moisture from the product and means for evacuating air from the drying vessel.

2. An apparatus according to claim 1 wherein the confining means is oriented generally upright such that the granular product will pass downwardly through it under the influence of gravity; wherein the apparatus further comprises a collecting tank located below the drying vessel, conduit means connecting the lower end of the confining means with the collecting tank so that the granular product will flow from the confining means into the collecting tank, and means within the collecting tank for controlling the rate at which the granular product leaves the conduit means and falls into the collecting tank; wherein the means for isolating the interior of the drying vessel also isolates the interiors of the collecting tank and conduit means from the surrounding atmosphere; and wherein the means for evacuating the pressure vessel also evacuates the collecting tank.

3. An apparatus according to claim 1 and further comprising a condenser for condensing steam derived from the moisture of the granular product; and wherein the evacuating means is connected with the interior of the drying vessel through the condenser.

4. An apparatus according to claim 1 wherein the confining means extends generally vertically through the drying vessel so the granular product will pass under the influence of gravity through the confining means.

5. An apparatus according to claim 3 wherein the confining means has walls that are perforated to enable moisture to escape from the interior of the confining means and into the surrounding portion of the drying vessel.

6. An apparatus according to claim 5 wherein the confining means comprises a plurality of sections which are aligned end-to-end.

7. An apparatus according to claim 6 wherein the confining means further includes bands which fit around the sections at their ends and maintain adjacent sections in alignment.

8. An apparatus according to claim 4 wherein the confining means is tubular and has spiral vanes on its inwardly presented surface.

9. An apparatus according to claim 8 wherein the vanes are arranged in succession through the tubular confining means and alternately spiral left and right.

10. An apparatus according to claim 1 wherein the vessel has an enclosing side wall and the transparent portion of the vessel is tubular and projects into the space surrounded by the enclosing side wall such that a drying cavity exists between the enclosing side wall and the transparent portion, and wherein the confining means is in the drying cavity.

11. An apparatus for drying a granular product, said apparatus comprising: an air-tight drying vessel having an enclosing side wall and a tubular portion which is surrounded by the side wall such that a drying cavity exists between the side wall and the tubular portion, the tubular portion being formed from a material that is transparent to microwave energy and having its hollow interior exposed to and confining air at substantially ambient pressure; confining means within the drying cavity of the vessel for defining a channel through which the product passes, said means being transparent to microwave energy; microwave generating means for producing microwave energy, the generating means being positioned and oriented to direct the microwave energy from the region of the ambient air within the tubular portion, through the transparent portion of the drying vessel and into the interior of the vessel such that the energy will pass through the confining means and evaporate the moisture from the product and means for evacuating air from the drying vessel.

12. An apparatus according to claim 11 wherein the confining means comprises at least one tubular column that extends through drying cavity.

13. An apparatus according to claim 12 wherein microwave generating means comprises a launcher unit located at one end of the tubular transparent portion of the vessel and being capable of producing microwave energy from electrical energy, and a waveguide-radiator extended from the launcher unit and into the interior of the transparent portion for directing the microwave energy into the tubular transparent portion and for permitting the microwave energy to escape along it such that the energy is directed through the transparent portion of the vessel and into the drying cavity between the transparent portion and enclosing side wall.

14. An apparatus according to claim 13 wherein the waveguide-radiator is formed from metal in a tubular configuration and is positioned such that the microwave energy emitted by the launcher unit passes through the hollow interior of the tubular configuration; and wherein the waveguide-radiator has apertures through which the microwave energy escapes from the hollow interior.

15. An apparatus according to claim 14 wherein the interior surface of the enclosing side wall for the vessel is formed from a substance that reflects microwave energy, and the apertures in the waveguide-radiator are offset from the tubular column of the confining means so that the microwave energy emitted from the waveguide-radiator does not pass directly through the confining means and the granular product within it, but instead reflects off of the enclosing side wall of the vessel to thereafter pass through the confining means and the granular product within it.

16. An apparatus according to claim 11 wherein the confining means comprises a plurality of drying columns located in the drying cavity of drying vessel at about the same elevation and with their longitudinal axes parallel.

17. An apparatus according to claim 16 wherein the microwave generating means comprises a plurality of tubular waveguide-radiators that extend through the interior of the tubular transparent portion of the vessel, each waveguide-radiator having apertures that open toward the wall of the transparent portion, the apertures being angularly offset from the drying columns so as not to direct the microwave energy directly at the drying columns.

18. An apparatus for removing moisture from a granular product, said apparatus comprising: a drying tank having an enclosing side wall and a tubular portion that is surrounded by the side wall such that a generally annular drying chamber exists between the side wall and the tubular portion, the tubular portion being formed from a material that is transparent to microwave energy and having its interior exposed to and filled with air at substantially atmospheric pressure; at least one drying column in the drying cavity of the drying vessel, the drying column being tubular and having walls that are transparent to microwave energy; meand for directing a granular product into the upper end of the drying column, whereby the product will descend through the column under the influence of gravity; a collecting tank connected to the lower end of the drying vessel for receiving the granular product after it passes out of the drying column; means for isolating the interiors of the drying vessel and the collecting tank from the surrounding atmosphere; means for evacuating air and other gases from the interiors of the drying vessel and collecting tank; a launcher unit located at one end of the tubular portion of the drying vessel, and being capable of producing microwave energy; and a waveguide-radiator formed from metal and being in a tubular configuration with one of its ends located at the launcher unit for receiving microwave energy produced at the launcher, the waveguide-radiator extending into the hollow interior of the tubular portion for the vessel and having apertures presented toward the transparent walls of the tubular portion so that microwave energy can escape from the waveguide-radiator and pass through the transparent walls of the tubular portion to dry the granular product in the drying column.

19. An apparatus according to claim 18 wherein the interior surface of the enclosing side wall for the drying vessel is formed from a material that reflects microwave energy, and the apertures in the waveguide-radiator are directed away from the drying column so that much of the microwave energy emitted from them reflects off of the enclosing side wall before passing through the granular product in the drying column.

20. An apparatus according to claim 19 wherein the column is formed from a plurality of sections positioned end-to-end in alignment with each section.

21. An apparatus according to claim 20 and further comprising means for controlling the rate at which the granular product passes through the drying column.

22. An apparatus according to claim 18 and further comprising a condenser having its interior in communication with the interior of the drying vessel and being connected with the evacuating means such that the air and other gases evacuated from the drying vessel pass through the condenser where water vapor therein is condensed.

23. An apparatus according to claim 22 wherein the launcher unit converts electrical energy into microwave energy, and further comprising a power supply connected with the launcher unit for supplying electrical energy to it, the power supply being located remote from the launcher unit.

24. An apparatus according to claim 23 wherein the collecting tank is located directly below the drying vessel and the launcher unit is located between the lower end of the drying vessel and above the upper end of the collecting tank.

25. A process for drying a granular product, said process comprising: introducing the product into a generally annular drying cavity that is enclosed by walls, two of which are generally concentric, with the inner of the two concentric walls being transparent to microwave energy and having its radially inwardly presented surface exposed to and at the same pressure as the ambient atmosphere; evacuating air from that cavity so that the pressure within the cavity is substantially less than atmospheric; within a region of substantially atmospheric pressure, generating microwave energy of a frequency capable of exciting molecules of water; and while still in the region of atmospheric pressure directing the microwave energy through the transparent wall such that it enters the drying cavity and evaporates moisture from the product.

26. The process according to claim 25 wherein the microwave energy is directed into the cavity such that much of its reflects off of walls of the outer of the two concentric walls before entering the product.

27. The process according to claim 25 wherein the microwave energy attenuates between the location at which it is directed at the transparent wall, with the attenuation being sufficient to prevent arcing and glow discharge within the drying cavity.

28. The process according to claim 25 and further comprising condensing the moisture that is evaporated from the product, said condensing occurring at the reduced pressure of the drying cavity so as to maintain the evacuated condition of the cavity.

* * * * *